US009169660B2

(12) United States Patent
Plenet et al.

(10) Patent No.: US 9,169,660 B2
(45) Date of Patent: Oct. 27, 2015

(54) ADHESIVE THRESHOLD BAR

(75) Inventors: Jean-Marie Plenet, Colombier-Saugnieu (FR); Michel Gergonne, Oyonnax (FR)

(73) Assignee: 3M Bricolage Et Batiment, Oyonnax (FR)

( * ) Notice: Subject to any disclaimer, the term of this patent is extended or adjusted under 35 U.S.C. 154(b) by 51 days.

(21) Appl. No.: 13/232,566

(22) Filed: Sep. 14, 2011

(65) Prior Publication Data

US 2013/0061548 A1 Mar. 14, 2013

(51) Int. Cl.
*E04F 19/02* (2006.01)
*E04F 19/04* (2006.01)
*E04F 19/06* (2006.01)

(52) U.S. Cl.
CPC ..... *E04F 19/063* (2013.01)

(58) Field of Classification Search
CPC ..... E04F 19/02; E04F 19/061; E04F 19/062; E04F 19/063; E04F 19/065; E04F 19/066; E04F 15/02; E04F 15/02005
USPC ..... 52/287.1, 396.04, 396.05, 395, 461, 52/459, 462, 463, 464, 466, 716.1, 716.8, 52/718.01, 718.04
See application file for complete search history.

(56) References Cited

U.S. PATENT DOCUMENTS

| | | | | |
|---|---|---|---|---|
| 346,077 | A * | 7/1886 | Vaile | 52/468 |
| 1,249,813 | A * | 12/1917 | Otte | 52/717.06 |
| 3,616,587 | A * | 11/1971 | Schlafly, Jr. | 52/287.1 |
| 3,745,056 | A * | 7/1973 | Jackson | 428/157 |
| 4,028,856 | A * | 6/1977 | Dalbec | 52/281 |
| 4,067,155 | A * | 1/1978 | Ruff et al. | 52/105 |
| 5,058,359 | A * | 10/1991 | Lindblom | 40/610 |
| 5,259,162 | A * | 11/1993 | Nicholas | 52/463 |
| 5,593,756 | A * | 1/1997 | Miller | 428/194 |
| 6,061,967 | A * | 5/2000 | Judds | 49/469 |
| 6,385,939 | B1 * | 5/2002 | Stout | 52/718.01 |
| 6,767,628 | B1 * | 7/2004 | Posa et al. | 428/343 |
| 2006/0048659 | A1 * | 3/2006 | Colson et al. | 101/272 |
| 2008/0034700 | A1 * | 2/2008 | Stanchfield et al. | 52/582.1 |
| 2008/0141597 | A1 * | 6/2008 | O'Rourke et al. | 52/62 |
| 2009/0229193 | A1 * | 9/2009 | Ellingson | 52/58 |
| 2010/0166451 | A1 * | 7/2010 | Von Schischka et al. | 399/98 |
| 2011/0047839 | A1 * | 3/2011 | Ross et al. | 40/124.08 |

FOREIGN PATENT DOCUMENTS

EP 196767 A * 10/1986

* cited by examiner

*Primary Examiner* — Jeanette E Chapman
(74) *Attorney, Agent, or Firm* — Sandra K. Nowak

(57) ABSTRACT

The invention relates to a transition element (5) formed of an elongated profile, having at its lower surface two first longitudinally-extending adhesive strips, each first strip being adhesive on its surface opposite to the profile, wherein each first strip is obtained by longitudinal folding of a sheet having a second strip glued against the profile.

14 Claims, 2 Drawing Sheets

ADHESIVE THRESHOLD BAR

BACKGROUND OF THE INVENTION

1. Field of the Invention

The present invention generally relates to threshold bars and other floor and wall covering transition elements.

2. Discussion of Prior Art

Threshold bars are elements fixed to the floor of residential, office, or industrial premises, at the junction of two floors of different natures or of different levels. A threshold bar has both a functional and an aesthetic purpose. It protects adjacent floor edges and masks their irregularities while defining a clear and straight separation line.

Other transition elements are used between the limit of a floor and a wall, also for functional and/or aesthetic reasons. For example, with wood flooring, it is desirable to leave a gap between the limit of the floor and the wall, to avoid expansion problems. The transition edging hides the gap and protects the edge of the floor.

Transition elements are also used against walls, for example, in the form of baseboards or beading for separating wall coverings.

FIG. 1 is a perspective cross-section view of part of a known threshold bar 2, called a threshold bar with guide rail, in position on a floor 11 on which floor coverings of different heights, respectively 12 and 13, for example, a fitted carpet and a tile, are deposited. Threshold bar 2 has a slightly convex visible upper portion, that may itself be painted or totally or partially covered with a material to give it any desired appearance. The lower portion of bar 2 comprises protruding ribs 21 and 22 defining, together and with lower portion 23 of bar 2, a longitudinal guide rail 24. Head 31 of a nail 32 may be inserted into this guide rail. This nail is intended to be driven into a hole formed in floor 11 into which a bushing 33 may or may not have been previously introduced.

FIG. 2 is a perspective view of a nail 3 illustrating a nail head shape particularly well adapted to guide rail 24 of bar 2. Head 31 has the shape of a half-cylinder perpendicular to a shank 32 of the nail and flattened on the side opposite to this shank. Half-cylinder 31 forms a slider capable of being slid in guide rail 24. Such a slightly elongated shape of sliders 31 enables a rotation of the nail head and thus of shank 32 of nail 3 to be avoided in a plane comprising the longitudinal guide rail axis. Thus, the shanks cannot lean in the guide rail during the driving-in phase. In the example of FIG. 3, nail 3 is a plastic "nail plug" provided with anti-wrenching fins 33, intended to be directly driven into a hole made in the floor.

The system of FIGS. 1 and 2 has the advantage of being easy to fit. Indeed, it is sufficient to prepare aligned holes in the floor without it being necessary to have precise intervals between them. A number of nails 3 corresponding to the number of holes are placed in the guide rail, after which the nails are installed by sliding them to be aligned with the corresponding holes, and the bar is pressed down, driving in the nails. This driving-in may be simply performed by stepping on the bar.

In the example of FIGS. 1 and 2, lower guide rail portion 23 is preferably V-shaped with a bearing edge 25 (FIG. 1) substantially bearing on the center of the planar upper surface of head 31 of nail 3. Further, the space between the opposite lips of ribs 21 and 22 is greater than the diameter of shank 32 of nail 3. Thus, once the nail has been placed in position, and until it has been fully driven in, the threshold bar may rotate slightly around the nail heads, the rotation axis corresponding to bearing edge 25. This enables a positioning and fixing for different heights of the interval between floor coverings 12 and 13. As shown in FIG. 1, the internal walls of ribs 21 and 22 have, towards their extremities, a shape complementary to the curve of slider 31. The angle of the V defining bearing edge 25 is preferably selected so that, when the threshold bar is positioned in an extreme of inclination, there is a simultaneous bearing of the nail shank against one of the lips of ribs 21, 22 and of the upper half of the nail head against one of the sides of the V.

A threshold bar such as illustrated in FIG. 1 is described in European patent 0588734 of the applicant.

Other threshold bars with guide rails are known, which define, in their lower surface, a guide rail adapted for the head of a screw-nail or nail plug. For example, the nail heads may have any desired cylindrical shape, for example, with a circular cross-section. Similarly, in a simple embodiment, the nail shanks may be threaded.

A structure inverse to that of FIG. 1 may also be contemplated, in which the bottom 23 of the guide rail is substantially planar and wherein it is the head 31 of the nail that has a convex V shape, the edge of the V defining an axis of rotation.

Drilling into the floor or the wall on which the transition element is to be fixed is not always possible or desired. Adhesive transition elements are then used on the surface of the covering.

FIG. 3 is a perspective view of part of another threshold bar, called a glued threshold bar. Threshold bar 4 is, like threshold bar 2 of FIG. 1, intended to mask the separation line between two floor coverings 13 and 12 (for example, of unequal height). The external aspect of threshold bar 4 is similar to that of threshold bar 2 and thus comprises a slightly convex visible upper portion, which may itself be painted or covered with a material to give it any desired appearance. Threshold bar 4 is fixed by gluing. To achieve this, two fillets 41 and 42 of glue are pre-positioned on the lower surface of bar 4 close to the longitudinal edges thereof. Before fitting, these fillets are generally protected by a peel-off paper strip which is removed by the user to apply the threshold bar.

A disadvantage of glue fillets is that they generate an extra thickness which adversely affects the appearance. Further, as time goes by and with the passing of people, glue fillets tend to flow, which generates a shift of the threshold bar or a cohesive failure of the adhesive.

Solutions comprising the application of a double-sided adhesive under a threshold bar for its fixing are also known. Such a solution is however only applicable to planar threshold bars. Indeed, such an adhesive strip does not adhere if it is placed under a threshold bar of variable height, for example, convex. Accordingly, it cannot be used for bars capable of adapting to floor coverings of variable or unequal height.

It would be desirable to be able to simply and reliably glue a convex threshold bar, possibly with a level adjustment.

Document GB-A-2425785 describes a profile system for joining together the edges of adjacent panels. This system comprises a rear component part supporting an intermediate connecting member and a front component part having an intermediate connecting member cooperating with that of the rear part. Two surfaces of the front part comprise adhesive strips.

SUMMARY OF THE INVENTION

An aim of an embodiment of the present invention is to provide an adhesive threshold bar or other transition element, which overcomes all or part of the disadvantages of existing threshold bars.

Another aim of an embodiment of the present invention is to provide a simple and efficient gluing solution.

Another aim of an embodiment of the present invention is to provide a solution particularly well adapted to threshold bars of variable height.

Another aim of an embodiment of the present invention is to provide a hybrid solution, adhesive or with a guide rail.

To achieve all or part of these and other aims, the present invention provides a transition element formed of an elongated profile, comprising at its lower surface two first longitudinally-extending adhesive strips, each first strip being adhesive on its surface opposite to the profile and being obtained by longitudinal folding of a sheet having a second strip glued against the profile.

According to an embodiment of the present invention, the second strip is glued on the lower surface of the profile.

According to an embodiment of the present invention, the second strip is glued on the upper surface of the profile.

According to an embodiment of the present invention, the second strip is a coating of the profile.

According to an embodiment of the present invention, the first adhesive strip is, in cross-section, offset towards the inside of the profile with respect to the edges thereof.

According to an embodiment of the present invention, the transition element further comprises, at its lower surface, an open longitudinal guide rail.

BRIEF DESCRIPTION OF THE DRAWINGS

The foregoing and other objects, features, and advantages of the present invention will be discussed in detail in the following non-limiting description of specific embodiments in connection with the accompanying drawings, among which.

DETAILED DESCRIPTION

Figure 1:
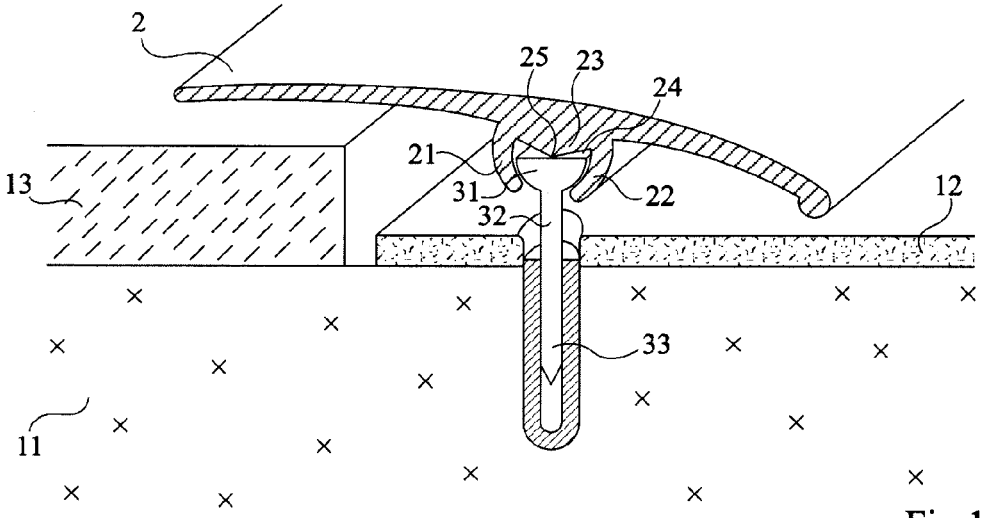
FIG. 1, previously described, is a perspective and cross-section view of a known threshold bar to be fixed with a nail or bushing.

The same elements have been designated with the same reference numerals in the different drawings, which have not been drawn to scale. For clarity, only those elements which are useful to an understanding of the present invention have been shown and will be described. In particular, the manufacturing of the profiles of the transition elements to which the present invention more specifically applies has not been detailed, the present invention being compatible with normal profiles. Further, although the present invention will be described hereafter in relation to an example application of threshold bars, the embodiments which will be described more generally apply to any transition element, be it a floor or wall covering transition element. Further, although the present invention will be described in relation to an example of a convex threshold bar, it more generally applies to any threshold bar or transition element, preferably of variable height.

Orientation and position terms "above", "under", "lower", "upper", etc. will be used by arbitrarily referring to a threshold bar in a position of use on a floor.

Figure 4:
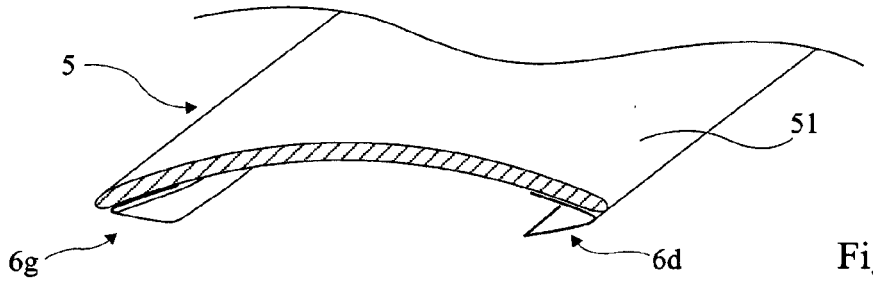
FIG. 4 is a partial view in perspective of an embodiment of a threshold bar according to the present invention.

FIG. 4 is a partial view in perspective of an embodiment of an adhesive threshold bar 5.

Figure 5:
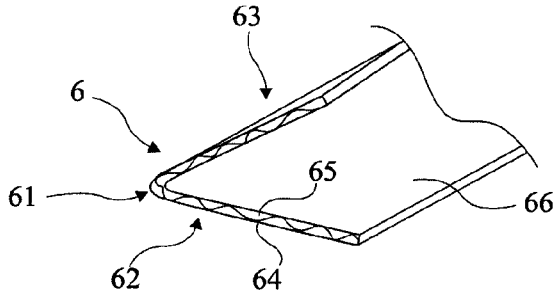
FIG. 5 is a partial view in perspective of a detail of an element for gluing the threshold bar of FIG. 4.

FIG. 5 is a partial view in perspective of a gluing strip of the threshold bar of FIG. 4.

As previously, threshold bar 5 comprises, in this example, a slightly convex visible upper surface 51, which may be painted or totally or partially covered with a material to give it any desired appearance. Most often, threshold bar 5 is made of aluminum.

On the inner surface, two gluing strips are placed close to the edges of the threshold bar. Each strip is formed of a strip 6 or one-sided adhesive sheet, longitudinally folded (fold 61, FIG. 5) so that the adhesive surfaces are exclusively outside of the obtained V shape. A first half-strip 63, arbitrarily the upper half-strip, of each strip 6*g*, 6*d* (FIG. 4), is pre-glued on each side of the lower surface of threshold bar 5, the V fold facing outwards. A protection film (64, FIG. 5), for example, a peel-off paper, is maintained before fitting to protect adhesive 65 of lower half-strip 62 intended to be fixed to the floor.

In practice, strip 6 is formed of a support sheet 66 coated with a thin glue film, and then with a protection film 64. For use on the lower surface of a threshold bar, this adhesive sheet is folded in two and protective film 64 is preferably longitudinally pre-cut to allow a pre-gluing of a strip of the sheet against the lower surface of the threshold bar (preferably in the factory). Preferably, strip 6 is located slightly inwards with respect to the bar edge to avoid any extra thickness.

The fitting of the threshold bar is particularly simple, the user removing protection strips 64 from both sides of the bar and applying the bar onto the floor. Surprisingly, the folding of sheet 6 provides it with a spring effect, which, light though it may be, is sufficient to press free strip 62 against the floor by means of the adhesive. This effect is improved if, during fitting, the user progressively removes protection strips 64 longitudinally as the fitting progresses. If desired, the user may first glue one of the two sides and press on it, then glue the second one as described hereabove.

Once the threshold bar has been glued, pressure applied thereon crushes the fold and suppresses any extra thickness.

Support material 66 of the adhesive film may be a paper or plastic sheet. The use of plastic has the advantage of providing an additional resistance and a better spring effect during fitting. As a variation, other materials may be used, for example, a metal or composite sheet.

Figure 6:
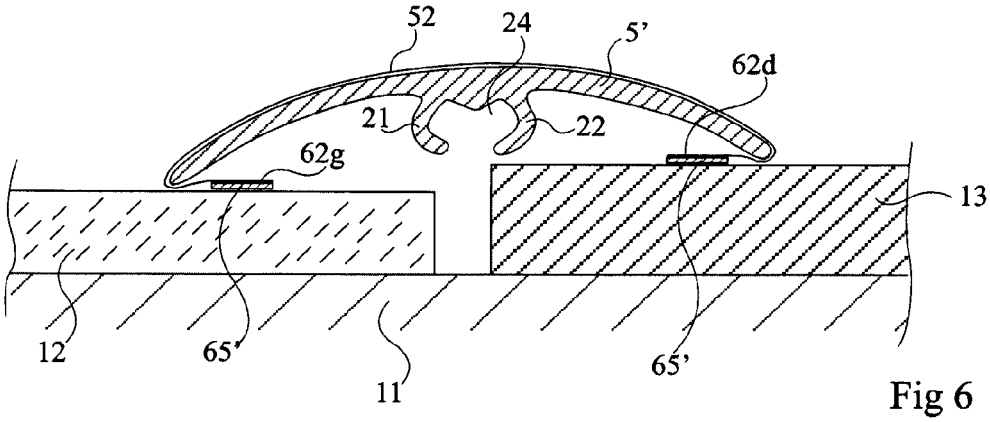
FIG. 6 is a cross-section view, in position, of another embodiment of a threshold bar according to the present invention.

FIG. 6 is a view in position of another embodiment of a threshold bar 5 also illustrating some variations.

In the example of FIG. 6, it is assumed that there is a need to adjust the level between two floor coverings 12 and 13 laid on a floor 11. Gluing strips 62*g* (to the left in the orientation of the drawing) and 62*d* (to the right in the orientation of the drawing) rest by their adhesive layers on floor coverings 12 and 13 and provide a gluing of threshold bar 5 with no extra thickness.

FIG. 6 illustrates a first variation according to which the half-strips fixed to the profile are an extension of a coating 52 of its upper surface. Such extensions, usually nipped and glued against the bar, are here instead adhesive on their external surface (adhesive strips 65'). According to another variation, not shown, half-strip 63 of a folded strip of the type shown in FIG. 5 is interposed between floor covering 52 and the profile of bar 5.

Figure 2:
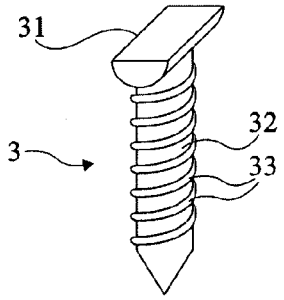
FIG. 2, previously described, is a perspective view of a nail plug of the threshold bar of FIG. 1.
Figure 3:
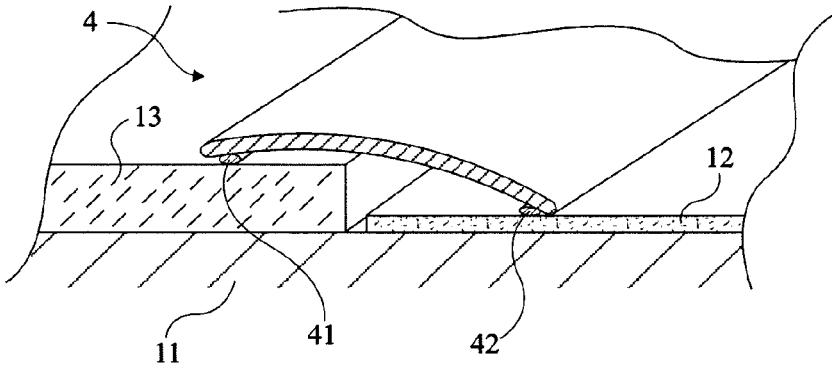
FIG. 3, previously described, is a perspective cross-section view of an existing glued threshold bar.

FIG. 6 illustrates another variation according to which the threshold bar is equipped at its internal surface with ribs 21 and 22 defining a guide rail 24 allowing a screw-nail or nail plug assembly (3, FIG. 2). This variation illustrates the possibility of forming a hybrid threshold bar, adhesive and with a guide rail. The distribution lines for threshold bars or like transition elements are thus simplified. The user may, as he wishes, fix the bar via its guide rail, glue it, or both.

Figure 7:
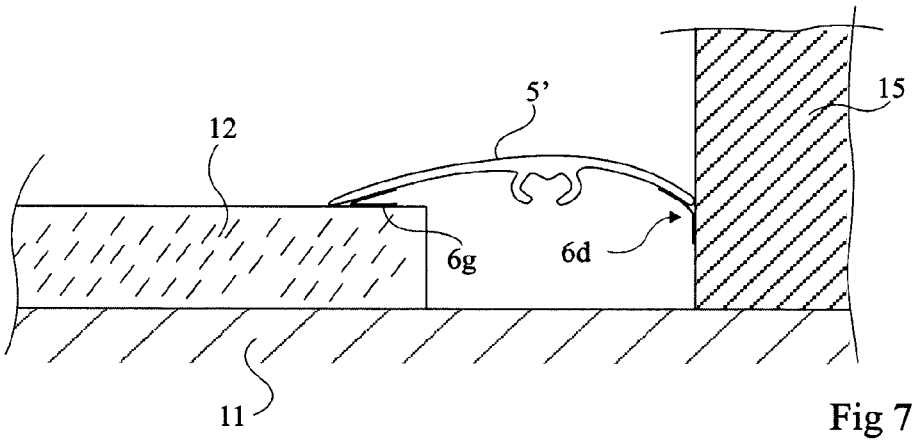
FIG. 7 is a cross-section view in another position of the threshold bar of FIG. 6.

FIG. 7 illustrates another example in position where a threshold bar 5' is glued at the border of a floor covering 12 of a floor 11 along a wall 15. Bar 5' is first glued by one of its strips 6*d* against wall 15 by opening the fold. It is then tilted back onto floor covering 12 where its strip 6*g* provides the adhesion.

An advantage of fold 61 (whether on strip 6 or at the level where coating 52 is folded back) is that it allows for a relatively large thickness of adhesive (see FIG. 6) in the case that the adhesive strip or half-strip is, in cross-section, slightly offset from the bar edge. There then remains no extra thickness after gluing.

While various embodiments have been described, various alterations and modifications will occur to those skilled in the art. In particular, the selection of the materials forming the adhesive strips is within the abilities of those skilled in the art based on the functional indications given hereabove and on the application. Similarly, the gluing dimensions (strip width) may be adapted according to the widths of the transition elements.

The invention claimed is:

1. A floor or wall transition element comprising:

an elongated profile; and two folded sheets each defining opposing first and second major surfaces and each having an adhesive layer on the corresponding first major surface, the folded sheets each defining longitudinally-extending first and second strips, wherein the second major surface of each of the folded sheets is free of adhesive;

wherein relative to an upright orientation of the floor or wall covering transition element in which an upper surface of the elongated profile is above a lower surface thereof, the first strips are positioned under the elongated profile and the corresponding adhesive first major surface of the first strips is opposite to the elongated profile, and the second strips are each glued to the lower surface of the elongated profile by the corresponding adhesive first major surface;

wherein the floor or wall transition element is capable of being either (1) fixed to a flooring at the junction of two floors of different natures or (2) fixed to a wall at the junction of the wall and another surface of a different nature.

2. The transition element of claim 1, wherein each of the first strips are, in cross-section, offset towards the inside of the elongated profile with respect to edges thereof.

3. The transition element of claim 1, further comprising an open longitudinal guide rail projecting from the lower surface of the elongated profile.

4. A floor or wall transition element comprising:

an elongated profile defining an upper surface and a lower surface; and a folded sheet defining two longitudinally extending first strips each having an adhesive layer, and a second strip, the first strips located at opposite sides of the second strip, respectively;

wherein relative to an upright orientation of the floor or wall transition element in which the upper surface of the elongated profile is above the lower surface, the first strips are positioned under the elongated profile such that the corresponding adhesive layer is opposite to the elongated profile, and the second strip is glued to the upper surface of the elongated profile;

wherein the floor or wall transition element is capable of being either (1) fixed to a flooring at the junction of two floors of different natures or (2) fixed to a wall at the junction of the wall and another surface of a different nature.

5. The transition element of claim 4, wherein the second strip is a coating of the upper surface of the elongated profile.

6. The transition of element of claim 4, wherein each of the first strips are, in cross-section, offset towards the inside of the elongated profile with respect to edges thereof.

7. The transition element of claim 4, further comprising an open longitudinal guide rail projecting from the lower surface of the elongated profile.

8. The transition element of claim 1, wherein each of the folded sheets includes a support sheet coated with a thin glue.

9. The transition element of claim 8, wherein the support sheet comprises a material selected from the group consisting of paper and plastic.

10. The transition element of claim 9, wherein the elongated profile is aluminum.

11. The transition element of claim 1, wherein the upper surface of the elongated profile is convex and the lower surface of the elongated profile is concave.

12. The transition element of claim 1, wherein the elongated profile is not folded on to itself.

13. The transition element of claim 1, wherein only a single fold line is defined in each of the folded sheets.

14. The transition element of claim 4, wherein the elongated profile defines opposing, first and second edges, and further wherein a first one of the first strips is located at the first edge, and a second one of the first strips is located at the second edge.

* * * * *